US011130617B2

(12) United States Patent
Ludwig et al.

(10) Patent No.: US 11,130,617 B2
(45) Date of Patent: Sep. 28, 2021

(54) THREE-CHAMBER BUBBLE VALVE

(71) Applicant: Illinois Tool Works Inc., Glenview, IL (US)

(72) Inventors: Christopher Ludwig, Buffalo Grove, IL (US); Christopher Nelli, Schaumburg, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 16/623,012

(22) PCT Filed: Jun. 14, 2018

(86) PCT No.: PCT/US2018/037466
§ 371 (c)(1),
(2) Date: Dec. 16, 2019

(87) PCT Pub. No.: WO2018/232069
PCT Pub. Date: Dec. 20, 2018

(65) Prior Publication Data

US 2021/0139212 A1 May 13, 2021

Related U.S. Application Data

(60) Provisional application No. 62/520,711, filed on Jun. 16, 2017, provisional application No. 62/545,229, filed on Aug. 14, 2017.

(51) Int. Cl.
*B65D 47/20* (2006.01)
*B65D 75/58* (2006.01)

(52) U.S. Cl.
CPC ..... *B65D 47/2018* (2013.01); *B65D 75/5822* (2013.01); *B65D 75/5811* (2013.01); *B65D 75/5883* (2013.01)

(58) Field of Classification Search
CPC ..... B65D 47/2018; B65D 75/5822; B65D 75/5811; B65D 75/5883
See application file for complete search history.

(56) References Cited

U.S. PATENT DOCUMENTS 3,184,121 A * 5/1965 Volckening ..... B65D 75/5811 222/213
4,328,912 A * 5/1982 Haggar ..... A61F 9/0008 222/212

(Continued)

FOREIGN PATENT DOCUMENTS

WO 2016164185 10/2016
WO 2018232069 12/2018

OTHER PUBLICATIONS

International Search report issued in PCT/US/2018/037466 dated Sep. 20, 2018.

*Primary Examiner* — Frederick C Nicolas
(74) *Attorney, Agent, or Firm* — McCarter & English, LLP

(57) ABSTRACT

The present disclosure relates to a closure which uses a bubble valve with three chambers. A transverse bubble element on the product side of the bubble valve can expand or inflate thereby inhibiting flow, or contract or deflate thereby allowing flow. A longitudinal bubble element to the side of the bubble valve is used to receive the contents from the transverse bubble element when the transverse bubble element is deflated.

20 Claims, 2 Drawing Sheets

(56) References Cited

U.S. PATENT DOCUMENTS

| | | | | |
|---|---|---|---|---|
| 4,592,493 | A * | 6/1986 | Smith | B65D 47/2031 222/212 |
| 6,641,307 | B2 * | 11/2003 | Matsuda | B65D 75/5866 383/38 |
| 7,207,717 | B2 | 4/2007 | Steele | |
| 7,883,268 | B2 | 2/2011 | Steele | |
| 8,613,547 | B2 | 12/2013 | Steele | |
| 8,806,842 | B1 * | 8/2014 | Penn | B65D 81/3266 53/453 |
| 9,963,284 | B2 | 5/2018 | Steele | |
| 2008/0279485 | A1 | 11/2008 | Steele | |
| 2011/0042407 | A1 * | 2/2011 | Steele | B31B 70/00 222/1 |

* cited by examiner

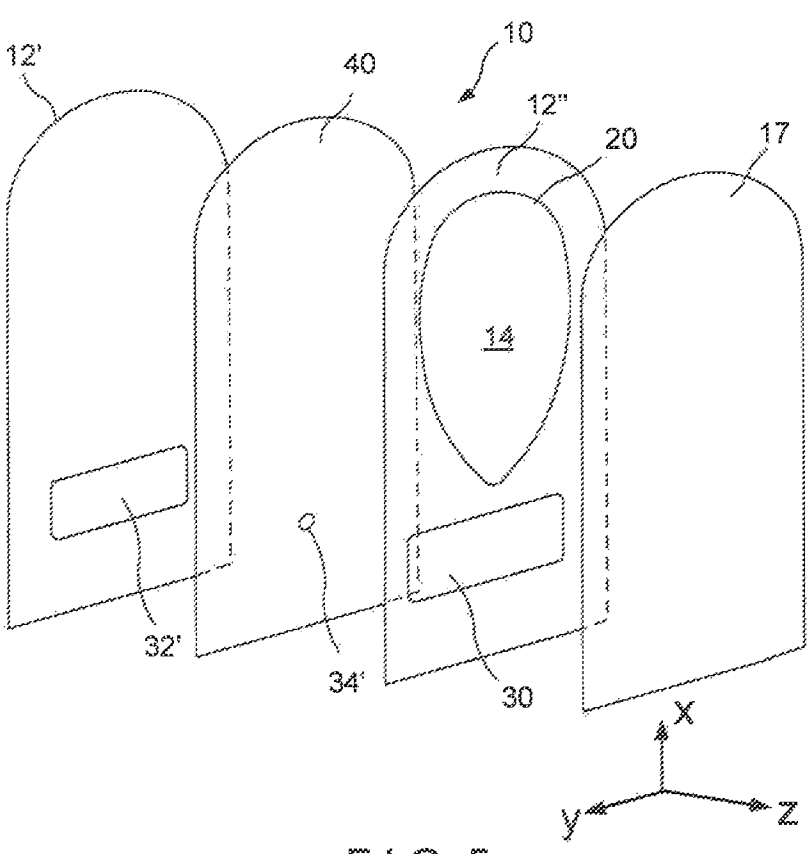
FIG. 5
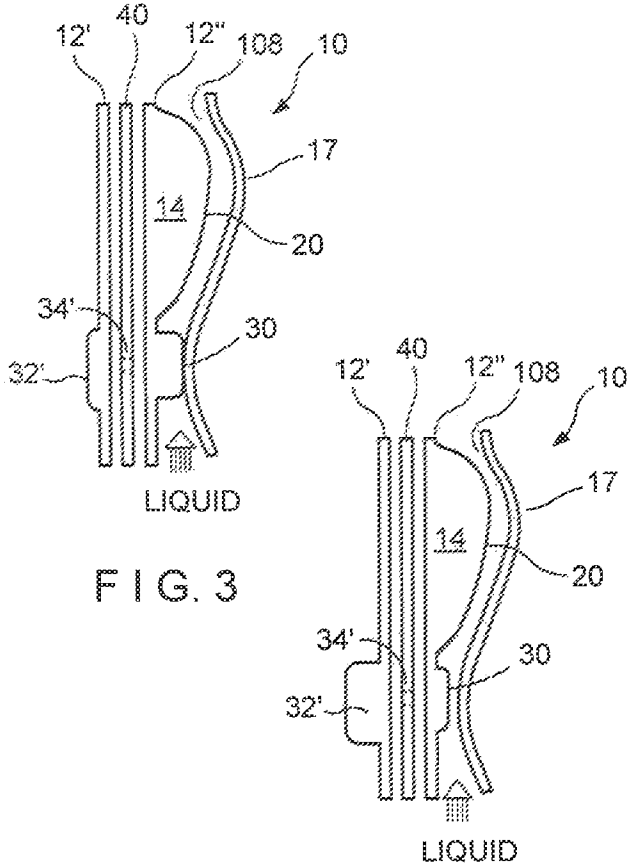
FIG. 4
FIG. 3

THREE-CHAMBER BUBBLE VALVE

This application is a National Phase of Application No. PCT/US2018/037466, filed Jun. 14, 2018 which claims priority of U.S. Provisional Application Ser. No. 62/520,711, filed on Jun. 16, 2017 and U.S. Provisional Application Ser. No. 62/545,229, filed on Aug. 14, 2017, the contents of the disclosure of both of which are incorporated by reference herein for all purposes.

BACKGROUND OF THE DISCLOSURE

Field of the Disclosure

The present disclosure relates to a closure which uses a bubble valve with three chambers. A transverse bubble element on the product side of the bubble valve can expand or inflate thereby inhibiting flow, or contract or deflate thereby allowing flow.

Description of the Prior Art

Prior art packaging in the food/beverage, personal care and household care industries is primarily a combination of a rigid bottle or semi-flexible tube with a rigid fitment or cap of varying dispense types. Transition to flexible pouches for the main body of the container has continued to utilize similar, still rigid, fitments. There exists a need within these industries to complete the transition in order to create a fully flexible solution.

Bubble valves or pressure-activated valves may be creating by forming a bubble of air, gas or other liquid between a base layer and a bubble layer. A flow channel is formed between the bubble layer and a channel layer. The pressure of the bubble layer against the channel layer may be used to control the flow of the dispensed material. Representative embodiments of a bubble valve or a pressure-activated valve are disclosed in U.S. Pat. No. 9,963,284 entitled "Package Valve Closure System and Method," issued on May 8, 2018 to Steele; U.S. Pat. No. 8,613,547 entitled "Packages Having Bubble-Shaped Closures," issued on Dec. 24, 2013 to Steele; U.S. Pat. No. 7,883,268 entitled "Package Having a Fluid Actuated Closure," issued on Feb. 8, 2011 to Steele; U.S. Pat. No. 7,207,717 entitled "Package Having a Fluid Actuated Closure," issued on Apr. 24, 2007 to Steele.

OBJECTS AND SUMMARY OF THE DISCLOSURE

It is therefore an object of the present disclosure to improve functionality by representing both a flow control mechanism and re-close feature, thereby enhancing the overall sustainability profile and cost reduction of the packaging through material reduction and operational efficiency gains.

BRIEF DESCRIPTION OF THE DRAWINGS

Further objects and advantages of the disclosure will become apparent from the following description and from the accompanying drawings, wherein:

FIG. 3 is a cross-sectional view of the closed configuration of a second embodiment of the bubble valve of the present disclosure.

FIG. 4 is a cross-sectional view of the open configuration of the second embodiment of the bubble valve of the present disclosure.

FIG. 5 is an exploded view of the second embodiment of the bubble valve of the present disclosure.

DETAILED DESCRIPTION OF THE PREFERRED EMBODIMENTS

Figure 2:
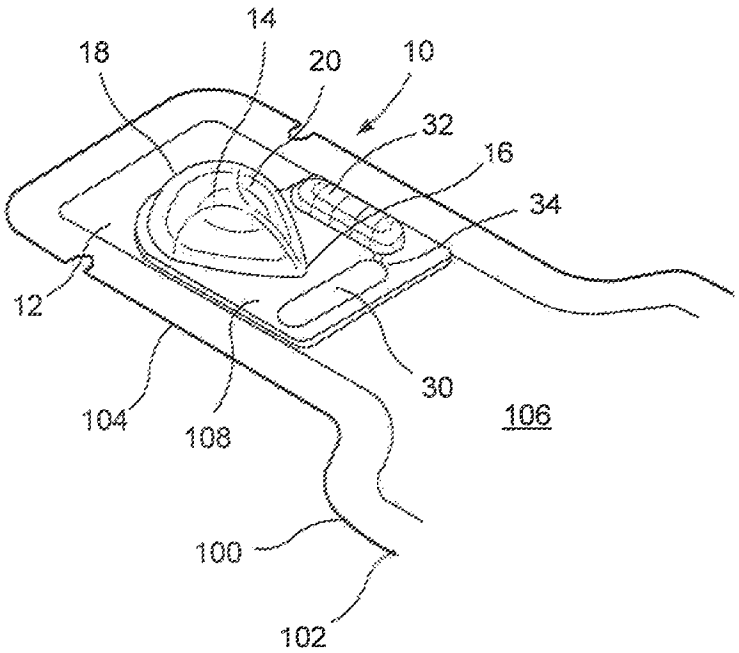
FIG. 2 is a perspective view illustrating the air dam permitting the liquid flow in the first embodiment of the present disclosure.
Figure 1:
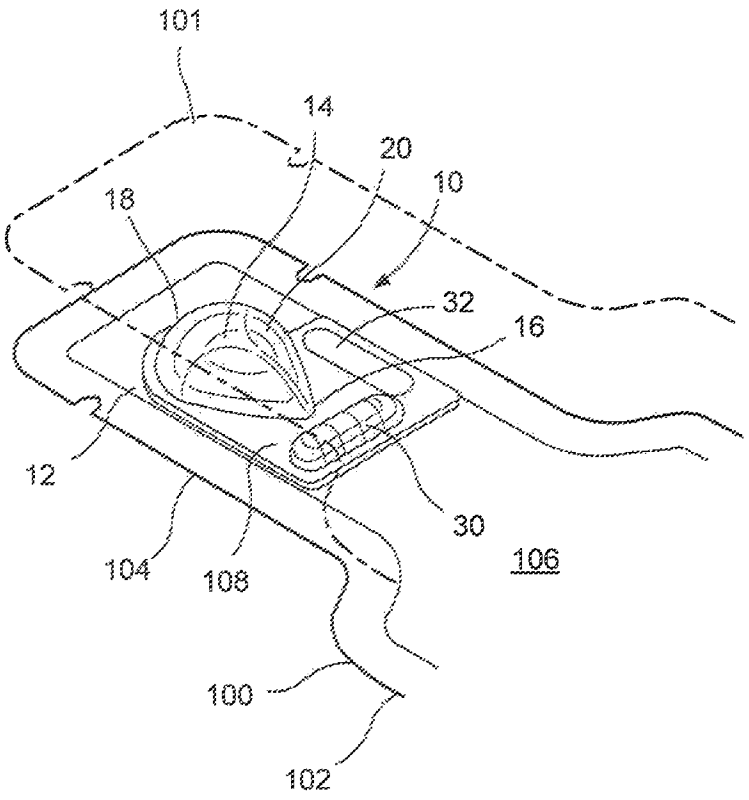
FIG. 1 is a perspective view illustrating the air dam stopping the liquid flow in a first embodiment of the present disclosure, a second wall is shown in phantom, as an exploded view.

Referring now to the drawings in detail, wherein like numerals indicate like elements throughout the several views, one sees that FIGS. 1 and 2 illustrate the respective closed and open configurations of a bubble valve 10 of the present disclosure. A first wall 100 of a container is illustrated. A second wall 101, a mirror image of first wall 100, is likewise provided as illustrated in FIG. 1 in an exploded phantom configuration. First wall 100 is illustrated in a bottle shape with a body portion 102 which is used to create a storage volume 106, when joined to the edges to second wall 101. The first wall 100 further includes a neck 104 which is used to form the fluid communication channel 108 from the storage volume 106 to the exterior of the container. The neck 104 further provides for the attachment of bubble valve 10 to control the flow through the fluid communication channel.

The valve 10 includes a substantial rectangular base layer 12, with a tear-shaped bubble 14, acting as a protruding valve element, formed thereon. The pointed end 16 of the tear-shaped bubble 14 faces the product side (i.e., faces the storage volume 106) of the configuration while the arcuate end 18 of the tear-shaped bubble 14 faces the consumer side of the configuration. The tear-shaped bubble 14 includes a flexible protruding wall 20, in the teardrop shape, which is filled with air, gas, or other fluid, and which serves as the bubble layer for the valve 10. The shaping and dimensions of the tear-shaped bubble 18, along with the film types can be customized to the specific needs of the product (including liquid viscosity) and/or user requirements. A channel layer (illustrated as element 17 in FIGS. 3-5) may be placed between the second wall 101 and the base 12, with the fluid communication channel 108 being formed between the tear-shaped bubble 14 and the channel layer.

The valve 10 further includes transverse bubble 30, formed on base layer 12, on the product side of tear-shaped bubble 14 for blocking flow of consumer product through the channel formed between tear-shaped bubble 14 and the channel layer (i.e., second wall 101) when transverse bubble 30 is inflated (see FIG. 1). Further, valve 10 includes longitudinal bubble 32, typically approximately the same size as transverse bubble 30, formed on base layer 12, to the lateral side of tear-shaped bubble 14 for permitting flow of consumer product through the channel formed between the tear-shaped bubble 14 and the channel layer, in view of the transverse bubble 30 being deflated and the longitudinal bubble 32 being inflated as shown in FIG. 2. In order to provide to selective inflation and deflation of transverse bubble 30 and longitudinal bubble 32 (i.e., one and only one bubble 30 or 32 being inflated at any one time, with the other bubble being deflated), a bubble fluid communication channel 34 is formed on or within base layer 12, providing fluid communication between transverse bubble 30 and longitudinal bubble 32 (see FIG. 2). The contiguous volume formed by transverse bubble 30, longitudinal bubble 32 and bubble fluid communication channel 34 is filled with enough air, gas or other fluid (which may be the same or different from the contents of tear-shaped bubble 26) to inflate one and only one of transverse bubble 30 or longitudinal bubble 32. The user manually presses transverse bubble 30 or longitudinal bubble 32 to inflate or deflate the selected bubbles 30, 32, thereby choosing between the closed or blocked configuration of FIG. 1 or the open configuration of FIG. 2. In one embodiment of FIGS. 1 and 2, the flow control bubble is static, not moving or changing shape. In another embodiment, the flow control bubble is dynamic, able to change shape and/or dimension.

That is, FIGS. 1 and 2 illustrate an embodiment of the present disclosure in which the air, gas or other fluid shifts between the transverse and longitudinal bubbles 30, 32 on an x-y plane between two or three layers of film. However, FIGS. 3-5 illustrate another embodiment of the present embodiment, in which air, gas or other fluid shifts between the first and second pockets along a z-axis. The embodiment of FIGS. 3-5 includes a fourth layer with a valve that acts as a membrane to allow the air to shift in a generally axial direction between bubbles.

In the embodiment illustrated in FIGS. 3-5, a membrane film 40, including bubble fluid communication aperture 34', is placed between outer base layer 12' and inner base layer 12". Inner base layer 12" includes interior transverse bubble 30, located similarly to that illustrated in FIG. 1. However, outer base layer 12' includes exterior transverse bubble 32', aligned with interior transverse bubble 30 in a direction perpendicular to the various layers of FIGS. 3-5 (i.e., in the "z" direction). In the configuration of FIGS. 3-5, the interior transverse bubble 30 functions the same as in FIGS. 1 and 2, inflating to block flow through fluid communication channel (see FIG. 3) and deflating to allow flow through fluid communication channel (see FIG. 4) while the exterior transverse bubble 32' functions substantially the same as the longitudinal bubble 32 in FIGS. 1 and 2, inflating in order to allow the deflation of interior transverse bubble 30, thereby allowing flow as shown in FIG. 4. The user manually presses on interior transverse bubble 30 or exterior transverse bubble 32' to move the air, gas or other fluid between the bubbles 30, 32' to selectively reach the closed position of FIG. 3 or the open position of FIG. 4.

In one embodiment of FIG. 5, the flow control bubble is static, not moving or changing shape. In another embodiment, the flow control bubble is dynamic, able to change shape and/or dimension.

Thus the several aforementioned objects and advantages are most effectively attained. Although preferred embodiments of the invention have been disclosed and described in detail herein, it should be understood that this invention is in no sense limited thereby.

What is claimed is:

1. A valve including:

a base;

a fluid communication channel formed adjacent to the base;

a protruding valve element on the base, extending into the fluid communication channel;

a first bubble element on the base, positioned on a product side of the protruding valve element and extending into the fluid communication channel, wherein inflation of the first bubble element blocks flow in the fluid communication channel to the protruding valve element; and a second bubble element on the base, positioned laterally from the protruding valve element, wherein inflation of the second bubble element allows flow in the fluid communication channel to the protruding valve element.

2. The valve of claim 1 wherein the protruding valve element is a third bubble element.

3. The valve of claim 2 wherein the third bubble element is filled with a first air, gas or fluid.

4. The valve of claim 3 wherein the first and second bubble elements are filled with a second air, gas or fluid.

5. The valve of claim 4 further including a bubble communication channel between the first bubble element and the second bubble element.

6. The valve of claim 5 wherein the first bubble element and the second bubble element include a total quantity of the first air, gas or fluid to inflate one and only one of the first bubble element and the second bubble element.

7. The valve of claim 6 wherein the first bubble element is positioned transversely along the fluid communication channel.

8. The valve of claim 7 wherein the second bubble element is positioned longitudinally along the fluid communication channel.

9. The valve of claim 8 wherein the third bubble element is teardrop-shaped with a pointed end directed to the product side and an arcuate end point to a consumer side.

10. The valve of claim 9 further including a channel layer, wherein the fluid communication channel is formed, at least in part, between the third bubble element and the channel layer.

11. A valve including:

a base;

a fluid communication channel formed adjacent to the base;

a protruding valve element on the base, extending into the fluid communication channel;

a first bubble element on the base, positioned on a product side of the protruding valve element and extending into the fluid communication channel, wherein inflation of the first bubble element blocks flow in the fluid communication channel to the protruding valve element, and deflation of the first bubble element allows flow in the fluid communication channel to the protruding valve element; and a second bubble element positioned on an opposite side of the base from the first bubble element, wherein inflation of the second bubble element allows deflation of the first bubble element.

12. The valve of claim 11 wherein the protruding valve element is a third bubble element.

13. The valve of claim 12 wherein the third bubble element is filled with a first air, gas or fluid.

14. The valve of claim 13 wherein the first and second bubble elements are filled with a second air, gas or fluid.

15. The valve of claim 14 further including a bubble communication channel between the first bubble element and the second bubble element.

16. The valve of claim 15 wherein the first bubble element and the second bubble element include a total quantity of the first air, gas or fluid to inflate one and only one of the first bubble element and the second bubble element.

17. The valve of claim 16 wherein the first bubble element is positioned transversely along the fluid communication channel.

18. The valve of claim 17 wherein the third bubble element is teardrop-shaped with a pointed end directed to the product side and an arcuate end point to a consumer side.

19. The valve of claim 18 further including a channel layer, wherein the fluid communication channel is formed, at least in part, between the third bubble element and the channel layer.

20. A valve including:

a base;

a fluid communication channel formed adjacent to the base;

a protruding valve element on the base, extending into the fluid communication channel;

a first bubble element on the base, positioned on a product side of the protruding valve element and extending into the fluid communication channel, wherein inflation of the first bubble element blocks flow in the fluid communication channel to the protruding valve element, and deflation of the first bubble element allows flow in the fluid communication channel to the protruding valve element; and a second bubble element separated from the first bubble element, wherein inflation of the second bubble element allows deflation of the first bubble element.

* * * * *